US007001473B2

(12) United States Patent
Waclaw

(10) Patent No.: US 7,001,473 B2
(45) Date of Patent: Feb. 21, 2006

(54) METHOD FOR PRODUCING PLATINUM ALLOYS AND ALLOYS WHICH CAN BE OBTAINED USING THIS METHOD

(75) Inventor: Jozef Wieczorek Waclaw, Ogrodnicza (PL)

(73) Assignee: Melick LLC, Boston, MA (US)

( * ) Notice: Subject to any disclaimer, the term of this patent is extended or adjusted under 35 U.S.C. 154(b) by 45 days.

(21) Appl. No.: 10/652,570

(22) Filed: Sep. 2, 2003

(65) Prior Publication Data

US 2005/0045254 A1 Mar. 3, 2005

(51) Int. Cl.
*C22F 1/14* (2006.01)

(52) U.S. Cl. ..... 148/678; 148/679; 148/553

(58) Field of Classification Search ..... 148/553, 148/678, 430, 679

See application file for complete search history.

(56) References Cited

U.S. PATENT DOCUMENTS 6,071,471 A * 6/2000 Winston ..... 420/467
6,562,158 B1 * 5/2003 Kretchmer ..... 148/678

* cited by examiner

*Primary Examiner*—George Wyszomerski
*Assistant Examiner*—Janelle Morillo
(74) *Attorney, Agent, or Firm*—Browdy and Neimark, PLLC

(57) ABSTRACT

Method for producing platinum/copper alloys which envisages the steps of melting platinum and copper parts and/or powders in a predetermined ratio in a controlled atmosphere, keeping the fusion product at the melting temperature for a given time period and subjecting the fusion product thus obtained to heat treatment so as to produce a platinum/copper alloy which is devoid of phase separation products and can be easily worked in the manner of a gold alloy.

12 Claims, 8 Drawing Sheets

METHOD FOR PRODUCING PLATINUM ALLOYS AND ALLOYS WHICH CAN BE OBTAINED USING THIS METHOD

TECHNICAL FIELD

The present invention relates to a method for producing platinum alloys and alloys which can be obtained using this method.

The method and the alloys forming the subject of the present invention may be advantageously used in the manufacturing industry for the production of semifinished articles made of precious alloys.

BACKGROUND ART

As is known, platinum, together with silver and gold, is one of the preferred metals widely used for the production of jewellery articles, among other things owing to its chemical stability and its aesthetic properties and colour which remain unchanged over time. Platinum, moreover, is distinguished by a high degree of malleability and ductility. However, generally it cannot be used in the pure state, but as an alloy together with other metals, such as palladium and indium, which increase its mechanical strength and allow it to be worked more easily.

Nowadays platinum and its alloys are widely used for setting precious stones, in particular diamonds, mainly because of their somewhat "neutral" colour which increases the brilliance of the stones. Consequently, as is known, nowadays the most famous diamonds are nearly all set in platinum mountings.

In the jewellery sector the platinum content of a product is usually indicated by means of an index—referred to as "purity index" —which is generally expressed as a fraction, i.e. thousandth part, of a metal with respect to the total weight of the said product. The platinum alloys which are currently used in the precious stones industry have standardized purity indices, i.e. 850/1000, 900/1000 or 950/1000. The same index may also be expressed in carats (K), in which case the fraction of metal with respect to the overall weight of the product is expressed as a twenty-fourth part (1/24), instead of a thousandth part, as indicated by the purity index.

For each platinum alloy, the choice of purity and metals which make up the alloy together with platinum, commonly referred to in the technical sector as "alloying elements", generally depends on commercial factors and the type of product which is to be obtained.

The alloying elements which are currently most frequently used are cobalt (Co), iridium (Ir), gold (Au), palladium (Pd), rhodium (Rh) and rhutenium (Ru). During the last few years, some of these metals, in particular palladium, rhutenium and rhodium, have reached prices which are comparable to, if not higher than, than that of platinum, so much so that they have resulted in a considerable increase in the final prices of the jewels made with these alloys.

A major drawback associated with the use of these alloys consists in the high melting temperature of platinum (1769° C.) which, as is known, complicates any process associated with the metallurgy of platinum and its alloys.

Moreover, the metallurgical plants and apparatus which are commercially available in the sector in question are almost exclusively intended for the goldsmith's sector, more specifically for the processing of gold, silver and alloys thereof which are distinguished by very simple metallurgical properties compared to those of platinum and its alloys.

Consequently, the plants envisaged in the gold and silver processing sector have proved to be totally inadequate for performing metallurgical operations on an industrial scale at the high temperatures which are required for platinum alloys. For example, the furnaces which are traditionally used for the processing of gold and silver alloys usually operate at temperatures which are much lower than those envisaged for platinum or its alloys.

The welding of semifinished articles made of platinum alloys is equally problematic owing to the high melting temperature of platinum which is not normally reached by the apparatus intended for the welding of gold alloys.

Welding with weld material at a lower melting temperature, such as for example braze-welding, although it is able to solve the problem associated with the high welding temperatures of platinum, is not convenient from a cost point of view considering the processing steps as a whole. In fact the use of impure weld material results in variations in the purity of the finished product, which must be necessarily taken into account, in some cases using complex calculations, in order to determine the final purity. For example, in order to compensate for the loss of purity due to the use of weld material, it may be envisaged initially using platinum alloys with fairly high fractions of platinum.

Advantageously, for practical reasons, the purity indices of the semifinished articles would need to be determined beforehand, at the time of melting, by calculating the number of welding operations necessary for achieving the end product. However, the management of a high and variable number of melting operations involving different purity indices is generally not practical and cost-effective.

It is known that the platinum alloys currently available on the market are distinguished, in mechanical terms, by a low elongation capacity, which limits the production of elongate semifinished articles in particular for chains, bands and the like. For this same reason, the manufacture of so-called "hollow" products, such as hollow chains, namely products which are able to house internally cores made of other materials, is also very problematic.

On average, platinum alloys of the known type have cold elongation values equal to 10% and therefore significantly lower than the elongation values of gold alloys which, depending on the purity and the alloying elements, are generally distinguished by elongation values ranging between 20% and 60%.

At present the elongation drawbacks of platinum alloys are partly overcome by using a fairly laborious alloy processing method which envisages alternating cold-rolling steps with annealing steps. In this way, during each annealing step, the internal tensions and the distortions in the crystal structure of the alloy produced during the prior rolling step are reduced, thus restoring the initial mechanical elongation properties prior to each new rolling step.

The process for the production of platinum semifinished articles is however, for this reason, penalized considerably in terms of time and cost (and therefore ultimately in terms of productive efficiency), compared to the corresponding production process for gold or silver semifinished articles.

As is known, major problems are also encountered with regard to recycling of the waste resulting from the processing of platinum alloys. In fact, pure and simple remelting of the waste does not eliminate the substances catalyzed by platinum during the course of the processing which it undergoes. Consequently, the waste is practically unusable and this obviously constitutes a major drawback from the point of view of cost-efficiency.

The well-known catalytic properties of platinum, which, as already mentioned, result in increased impurities in its processing waste, also give rise to difficulties which are encountered in the processes for diamond-cutting semifinished articles made of platinum or alloys thereof. The diamond-cutting process consists in cutting and mechanically removing, in the cold state, surface layers from products using diamond-tipped tools. By means of this process, which is practically indispensable in the precious stones industry, it is possible to obtain particularly shiny surfaces and light effects which enhance the semifinished article.

The traditional tools used in the diamond-cutting of precious metals such as gold and silver have proved to be totally inadequate for performing the diamond-cutting of platinum since their diamond-coated parts are subject to an exceptional degree of wear, which is not even comparable to that encountered with gold. This wear is generated not so much by the mechanical abrasive action produced by the platinum surface, which is very soft, but by the chemical attack produced by the platinum catalysis processes on the carbon crystal structure of the diamond.

Owing to the rapid wear of the diamond parts in fact, the diamond-cutting of products made of platinum or its alloys is currently unsustainable from a cost point of view.

DISCLOSURE OF THE INVENTION

In this situation, the main object of the present invention is to provide platinum alloys having aesthetic properties which are comparable to those of the present platinum alloys and possessing mechanical machinability properties, and in particular percentage elongation values, which are comparable to those of the current gold and silver alloys. Another object of the present invention is to provide platinum alloys which are aesthetically similar to the platinum alloys which are currently available commercially, but which are able to undergo welding and diamond-cutting operations with time and cost factors comparable to those of gold and silver alloys. A further object of the present invention is to provide an economically simple and reliable method for the production of platinum alloys having mechanical machinability properties which are comparable to those of the current gold alloys.

Advantageously, the platinum alloys obtained with the method according to the invention are distinguished by elongation values ranging between 30% and 60% and comparable to the elongation values of traditional gold alloys. These alloys according to the invention are thus cold-machinable with rolling and annealing cycles which are decidedly shorter than those envisaged for the current platinum alloys. With the same platinum alloys according to the invention it is possible to produce articles with a hollow core, such as hollow chains.

A further advantage consists in the fact that the articles produced using the platinum alloys according to the invention may now undergo diamond-cutting operations resulting in wear of the tools which is comparable to that which can be encountered with gold alloys.

Finally, it must be noted that the platinum alloys according to the invention may be welded using blowtorch and laser techniques with execution times and procedures typical of gold and silver alloys.

The method according to the present invention envisages processing steps which are simple to manage from a production point of view and which allow the method to be adapted in a flexible manner to the market requirements.

BRIEF DESCRIPTION OF THE DRAWINGS

The technical features of the invention, in accordance with the abovementioned objects, may be clearly determined from the contents of the claims indicated below and the advantages thereof will emerge more clearly from the following detailed description, provided with reference to the accompanying drawings which show a purely exemplary and non-limiting embodiment thereof and in which:

DETAILED DESCRIPTION

Figure 1:
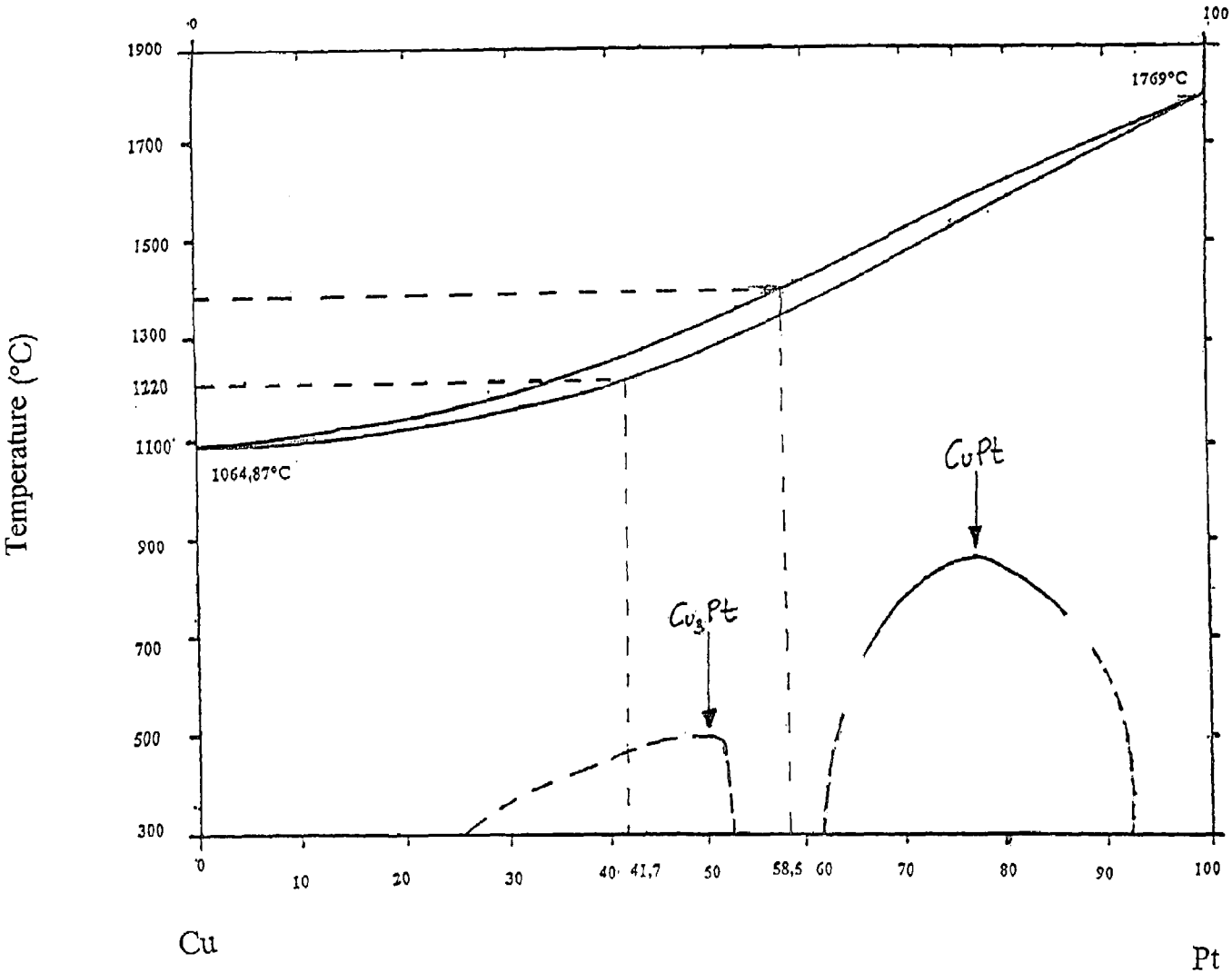
FIG. 1 is a status diagram of the binary alloys Pt—Cu.

The present invention relates to a method for producing platinum alloys, which comprises essentially the operating steps described below.

Once the platinum purity index to be obtained has been defined, melting of a predefined and corresponding quantity of platinum and a predefined and corresponding quantity of copper is performed so as to obtain a fusion product with a corresponding predetermined platinum purity index.

The method according to the present invention envisages preferably the use of copper as a sole alloying element, although it is also possible to envisage methods which also use other alloying elements, albeit in smaller amounts, but nevertheless falling with the scope of protection of the present invention.

Once an operating temperature equal to the melting temperature of the prechosen alloy or equal to a temperature higher than the abovementioned melting temperature has been reached, it will be possible to keep this fusion product at this temperature for a time period which will be defined more specifically below, resulting in a holding step suitable for homogenizing the fusion product.

According to the invention, the fusion product is then subjected to a heat treatment which consists in keeping it at temperatures in the range of 900° C. to 1400° C. for a time period ranging from 2 to 20 hours.

This heat treatment avoids the formation of phase separation compounds, otherwise present in the crystal structure, and destroys any such compounds which may have already formed. Consequently, it results in a homogeneous distribution, in various points, of the elements which form the alloy.

The platinum/copper alloys obtained according to this method are distinguished by a crystal structure devoid of phase separation compounds. These same alloys are also distinguished by aesthetic properties comparable to those of the current platinum alloys and by mechanical machinability properties and in particular elongation properties comparable to those of the current gold and silver alloys.

These results were achieved using alloys with a platinum purity index or content variable between 375/1000 and 800/1000 and in particular advantageously between 375/1000 and 585/1000. Within these ranges, commercial purity indices of 375/1000, 417/1000, 585/1000, 750/1000 and 800/1000 are preferably chosen. Moreover, preferably the copper content represents the entire residual fraction of the overall weight of the alloy, being variable only in relation to the platinum content which is to be obtained. The same method may envisage, however, using also different alloying elements, in addition to copper, as the main alloying element without thereby departing from the inventive idea of the method claimed.

In accordance with a preferred further characteristic feature of the present invention, the holding step is carried out at operating temperatures higher than the melting temperature of the fusion product. As a result, it is possible to ensure a particularly uniform and homogeneous distribution of the alloying elements in the fused mass of the fusion product. This same step may be carried out for a time period ranging from 1 to 10 hours, depending on the pre-set operating temperature. With an increase in the operating temperature, the homogenization time of the fusion product may be reduced.

Owing to the heat treatment envisaged in the method according to the present invention, the formation of preferential divisions and phase separation compounds, such as $Cu_3Pt$ or Cupt, which normally form at temperatures lower than the melting temperature of the platinum alloy, is eliminated.

Figure 6:
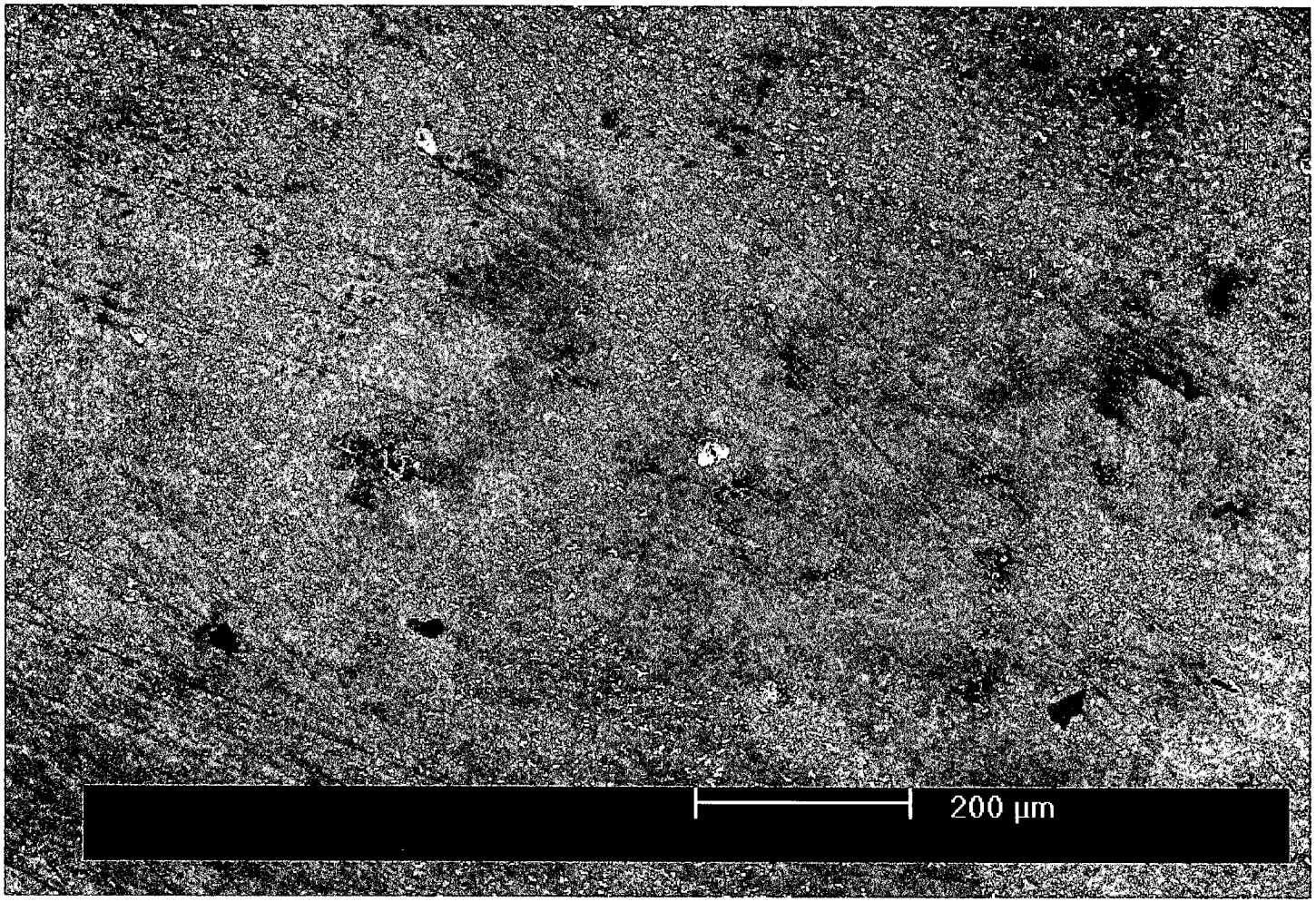
FIG. 6 is a microphotograph which shows the image, obtained by a scanning electron microscope (SEM), of a sample of a Pt alloy according to the invention prior to the heat treatment envisaged by the method according to the present invention.

The above may be appreciated in qualitative terms from the microphotographs—shown in FIGS. 7 to 10 and taken using a scanning electron microscope (SEM)—of an alloy sample according to the invention. Comparing these microphotographs with that of FIG. 6 showing an alloy sample having an identical composition, but produced using a traditional method without the abovementioned heat treatment step, it can be immediately seen that there is a greater homogeneity in the crystal structure of the sample produced with the method according to the invention and that there is a total absence of preferential divisions of alloying elements.

These qualitative observations were confirmed by concentration analyses performed using the EDAX (Energy Dispersion X-ray) technique. It can therefore be confirmed that the alloys produced with the method according to the invention have platinum purity indices which are substantially constant throughout their mass.

This fact has a positive effect on the mechanical machinability properties of the alloys thus obtained.

In fact, the platinum alloys obtained using the method according to the present invention are distinguished by elongation values ranging between 30% and 60%.

These elongation values in these alloys are physically justifiable precisely owing to the lack of phase separation compounds, such as $Cu_3Pt$ or CuPt. These same compounds are instead present in the Pt—Cu alloys of the known type, as can be observed from the status diagram for Pt—Cu alloys shown in FIG. 1, and, obstructing the movements within the crystal structure, reduce considerably the cold elongation of the material. Tensile tests carried on Pt—Cu alloy samples which have these phase separation product divisions in their crystal structure have in fact produced elongation values which are close to 0% and which currently make cold-working of these alloys absolutely impossible.

Moreover, the currently known metallurgical methods do not provide any teaching as to how to avoid the formation of these phase separation compounds in Pt—Cu alloys, wherein it is by no means commonplace to encounter the absence of these divisions as a result of the heat treatment devised.

From the status diagram shown in FIG. 1 it is possible to determine, as a function of the platinum content, the melting temperatures of the alloys according to the invention. The lower melting temperatures compared to the commercially available platinum alloys facilitate the melting of the edges or portions to be joined together by means of welding.

In welding tests carried out on products made with platinum/copper alloys obtained by means of the method according to the invention it has been possible to confirm the possibility of performing blowtorch welds, normally used in the gold and silver processing sector, with time and gas consumption values (well-known to persons skilled in the art) comparable to those of gold alloys. Alloys with a platinum content of 375/1000, 417/1000 and 585/1000 required welding times shorter than those of alloys with a higher content. Results comparable to those which can be obtained with gold alloys were also recorded in the case of the laser welding technique.

Diamond-cutting tests carried out on the alloys produced using the method according to the invention have confirmed the improved processability properties which can be achieved by these alloys. During the tests, in fact, it was observed that the wear of the diamond-coated tools was entirely comparable to that found during diamond-cutting of the usual gold alloys and well-known to the person skilled in the art.

Therefore, the diamond cutting technique, which was use to limited extent on the platinum alloys known hitherto owing to the extremely high operating costs, may now be used extensively on alloys obtained with the method according to the invention without any problems and in an entirely cost-effective manner, as already occurs in the case of gold alloys.

Figure 3:
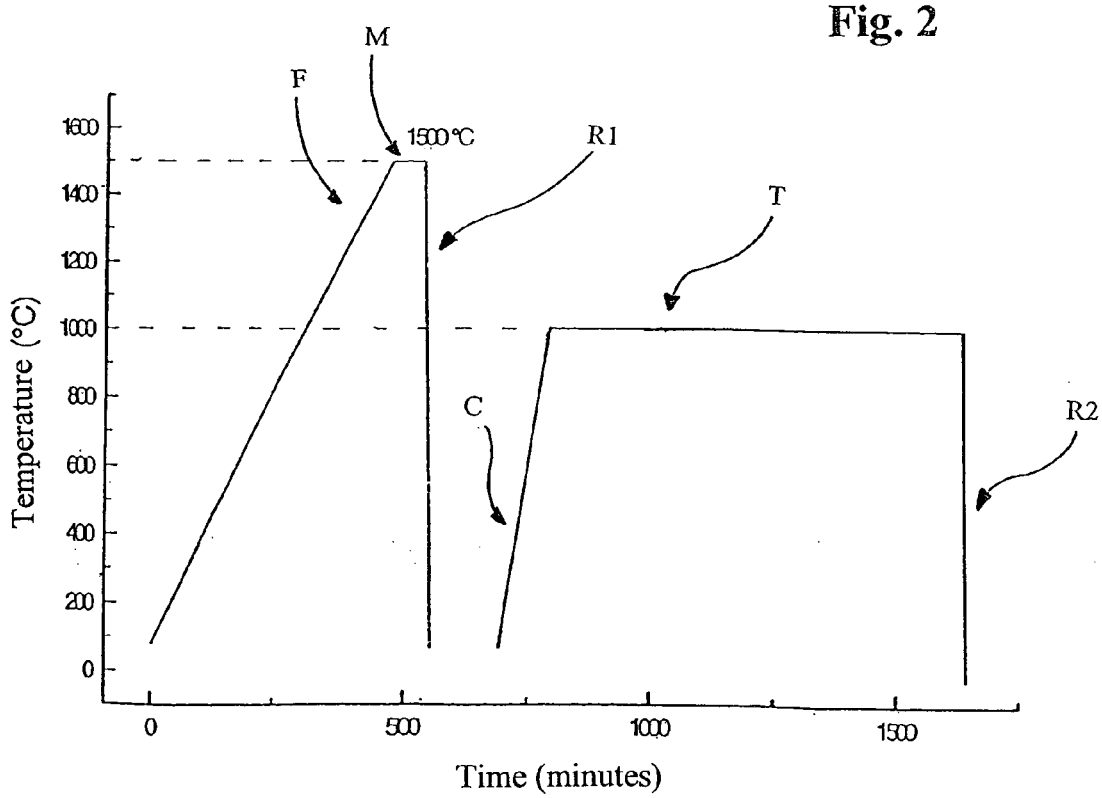
FIG. 3 is a time-temperature graph illustrating, in schematic form, the steps of the method according to the invention, as conducted in Example 2.

A first preferred embodiment of the method according to the invention is schematically illustrated in FIG. 3 and relates in particular to a platinum/copper alloy with a platinum content of 585/1000. With reference to the accompanying figures, below the melting step will be indicated by F, the holding step by M and the heat treatment step by T.

Advantageously, the melting step F is distinguished by an operating temperature about 100° C. above the melting temperature of the mixture of alloying elements, and the holding step M which follows the melting step is carried out for a time period of 5 hours.

At the end of the holding step M, a first cooling step R1 is envisaged so as to bring the fusion product to room temperature. Cooling may be performed using a hardening agent, as indicated in the graph of FIG. 3, or may be carried out at a cooling speed chosen in the range of 1° C./min. to 20° C./min.

The product obtained after this first cooling step is subjected to a heating step C up to a temperature ranging between 900° C. and 1400° C., with a heating speed which may be chosen in the range of 1° C./min. to 15° C./min. A preferred value for the heating speed is 15° C./min. This heating step C is then followed by the heat treatment T which, as already mentioned, consists in keeping the product at temperatures of between 900° C. and 1400° C., for a period of time chosen from the range of 2 to 20 hours.

Preferential values proved to be 1000° C. for the temperature and 17 hours for the duration of the treatment T.

A second cooling step R2 down to room temperature is envisaged at the end of the heat treatment T. This may again be achieved by means of a hardening process or a cooling speed chosen with a rate in the range of 1° C./min. to 20° C./min. For reasons of a practical and cost-related nature relating to the production process, it is preferred to perform the abovementioned cooling step R2 by means of a hardening process, as indicated in the graph according to FIG. 3.

Advantageously, as per the embodiment of the method according to the invention described above, it is possible to interrupt the production process immediately after the first cooling step, at a suitable point, where the alloy obtained is such that it can be easily stored in a warehouse. The same alloy may be subjected conveniently only at a later stage to the subsequent steps of the method in question so as to obtain a product according to the invention. The method thus devised may be optimized in a flexible manner according to production requirements.

Figure 2:
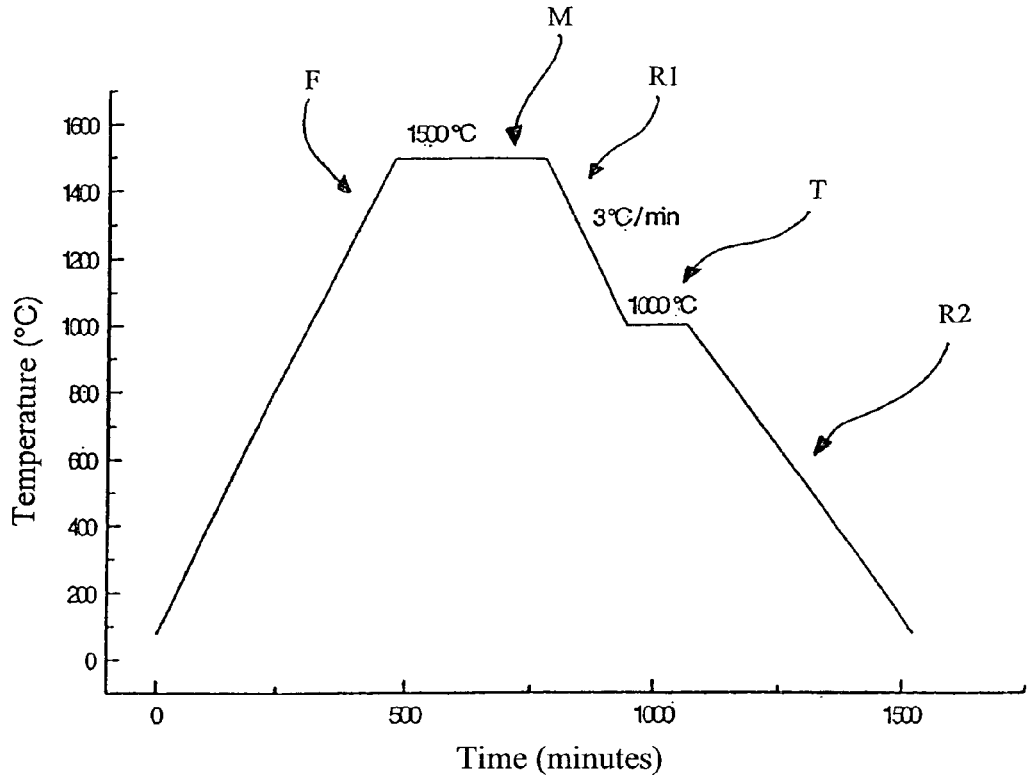
FIG. 2 is a time-temperature graph illustrating, in schematic form, the steps of the method according to the invention, as conducted in Example 1.
Figure 4:
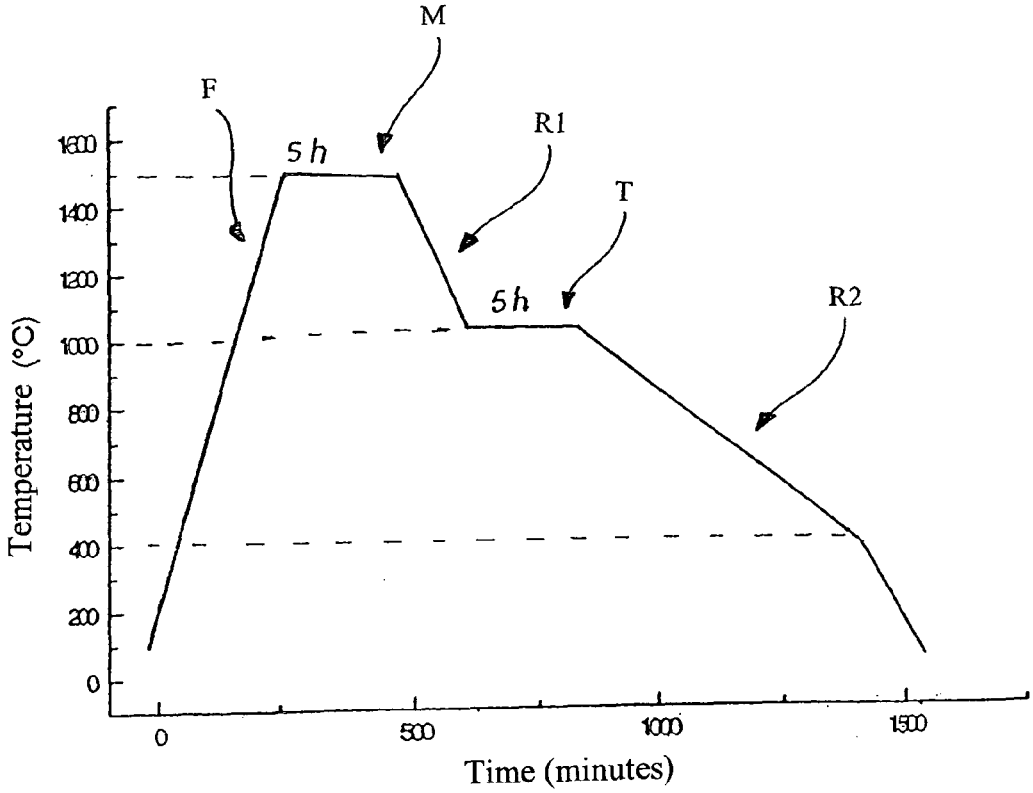
FIG. 4 is a time-temperature graph illustrating, in schematic form, the steps of the method according to the invention as conducted in Example 3.
Figure 5:
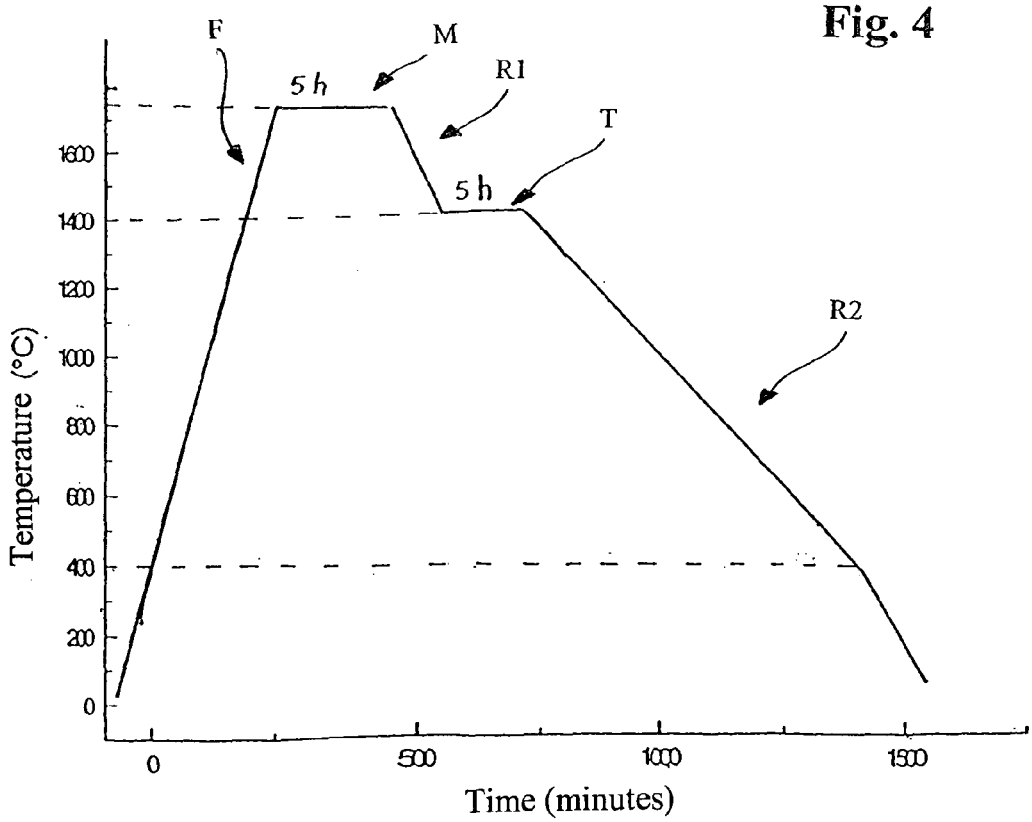
FIG. 5 is a time-temperature graph illustrating, in schematic form, the steps of the method according to the invention as conducted in Example 4.

Another embodiment of the method is schematically shown in FIGS. 2, 4 and 5. The working process is envisaged without interruption between the different steps. At the end of the holding step M a first cooling step R1 is envisaged in order to cool the fusion product down to temperatures in the range of 900° C. to 1400° C. The cooling speeds are chosen from the range of 1° C./min. to 20° C./min. A preferred value for the cooling speed is chosen as 3° C./min.

Subsequently, following this first cooling step R1, the heat treatment T is envisaged. Preferred values for the temperature and treatment times are 1000° C. for 2 or 5 hours, as respectively indicated in FIG. 2 or FIG. 4, or 1400° C. for 5 hours, as indicated in FIG. 5. The heat treatment T is followed by a second cooling step R2 down to room temperature with a cooling speed chosen from the range of 1° C./min. to 20° C./min.

During this second cooling step R2 it is also possible to vary the cooling speed, as shown by the varyingly inclined sections of the thermal profile of the step R2 illustrated in the graphs of FIGS. 4 and 5. Alternatively the step R2 may be performed by means of hardening.

Advantageously, this second embodiment of the method allows a reduction in the processing tines for a single part since interruptions in the production process are not envisaged.

The method according to both embodiments illustrated envisages preferably that the melting and holding steps are performed in a controlled atmosphere achieved by means of a vacuum or by means of an inert gas flow. It is thus possible to avoid oxidation of the fusion products and ensure a greater quality of the end products.

EXAMPLE 1

Preparation of a Pt—Cu Alloy with 585/1000 Purity Index 87.745 g of Pt and 62.318 g of Cu, both in powder form, were mixed together so as to obtain a homogeneous mixture of powders. The mixture was then placed in an alumina crucible. The total weight of the crucible and the mixed powders was equal to 277.6 g.

The crucible containing the powders was placed in a tubular furnace, leaving it in a flow of argon (Ar) for about one hour so as to eliminate the oxygen from the furnace, before the start of the process.

Both the melting step and the holding step were carried out in the argon flow. As illustrated in the graph according to FIG. 2, fusion of the mixture was achieved at 1500° C. with a heating speed of about 3° C./min. and the fusion product was held at 1500° C. for 5 hours (holding step M).

The fusion product was then cooled (cooling step R1) at a speed of about 3° C./min. down to 1000° C., continuing with the heat treatment T at this temperature for about 2 hours. Subsequent cooling (cooling step R2) was performed at a cooling speed of about 2° C./min. down to room temperature.

The total time of the process was just over 1500 minutes.

The abovementioned process produced a brilliant light grey block without traces of oxidation, having a rough surface, especially the surface not making contact with the walls of the crucible.

The weight of the crucible and the sample was equal to about 276.7 g, with a weight loss of 0.9 g, equivalent to less than 1% of the total weight of the alloy.

The alloy thus obtained had a platinum content of 585/1000 (14K) and was suitable for welding, with or without weld material substantially using the same procedures as a traditional gold alloy, as well as being suitable for diamond-cutting with diamond wear equivalent to that encountered for traditional gold alloys. The alloy obtained with this method proved suitable for obtaining so-called "hollow" articles, in a manner entirely similar to that of conventional gold alloys.

EXAMPLE 2

Preparation of a Pt—Cu Alloy with 585/1000 Purity Index 87.745 g of Pt and 62.318 g of Cu, both in powder form, were mixed together so as to obtain a homogeneous mixture of powders. The mixture was then placed in an alumina crucible. The total weight of the crucible and the mixed powders was equal to 277.6 g.

The crucible containing the powders was placed in a tubular furnace, leaving it in a flow of argon (Ar) for about one hour so as to eliminate the oxygen from the furnace, before the start of the process.

Both the melting step and the holding step were carried out in the argon flow.

The holding step M at 1500° C. was performed for about 1 hour and was followed by cooling to room temperature by means of hardening (cooling step R1), as illustrated in the graph shown in FIG. 3, producing a grey coloured block of rough product.

Subsequently the process was continued with heating to 1000° C. (heating step C), at a speed of about 10° C./min. Subsequent heat treatment T at 1000° C. lasted about 17 hours (about 1000 min.), followed then by cooling to room temperature by means of hardening (cooling step R2).

An end product with the same characteristics as that obtained in Example 1 was obtained, said product having a platinum content of 585/1000 (14K).

After initial cooling by means hardening, a sample of the product was subjected to analysis by means of a scanning electron microscope (SEM) and using the EDAX (Energy Dispersion X-ray) technique. The SEM microphotograph of FIG. 6 shows the granular structure of the sample not subjected to heat treatment. It is possible to note a certain number of distinctly non-homogeneous zones characterized by divisions of phase separation products. The results of the EDAX concentration analyses carried out at various points on this sample produced concentration values which have a 10% deviation from the average purity index of 585/1000 of the product. Even taking into account the error in the EDAX technique, which can be calculated at about ±5%, the lack of homogeneity of the sample is notable.

Figure 7:
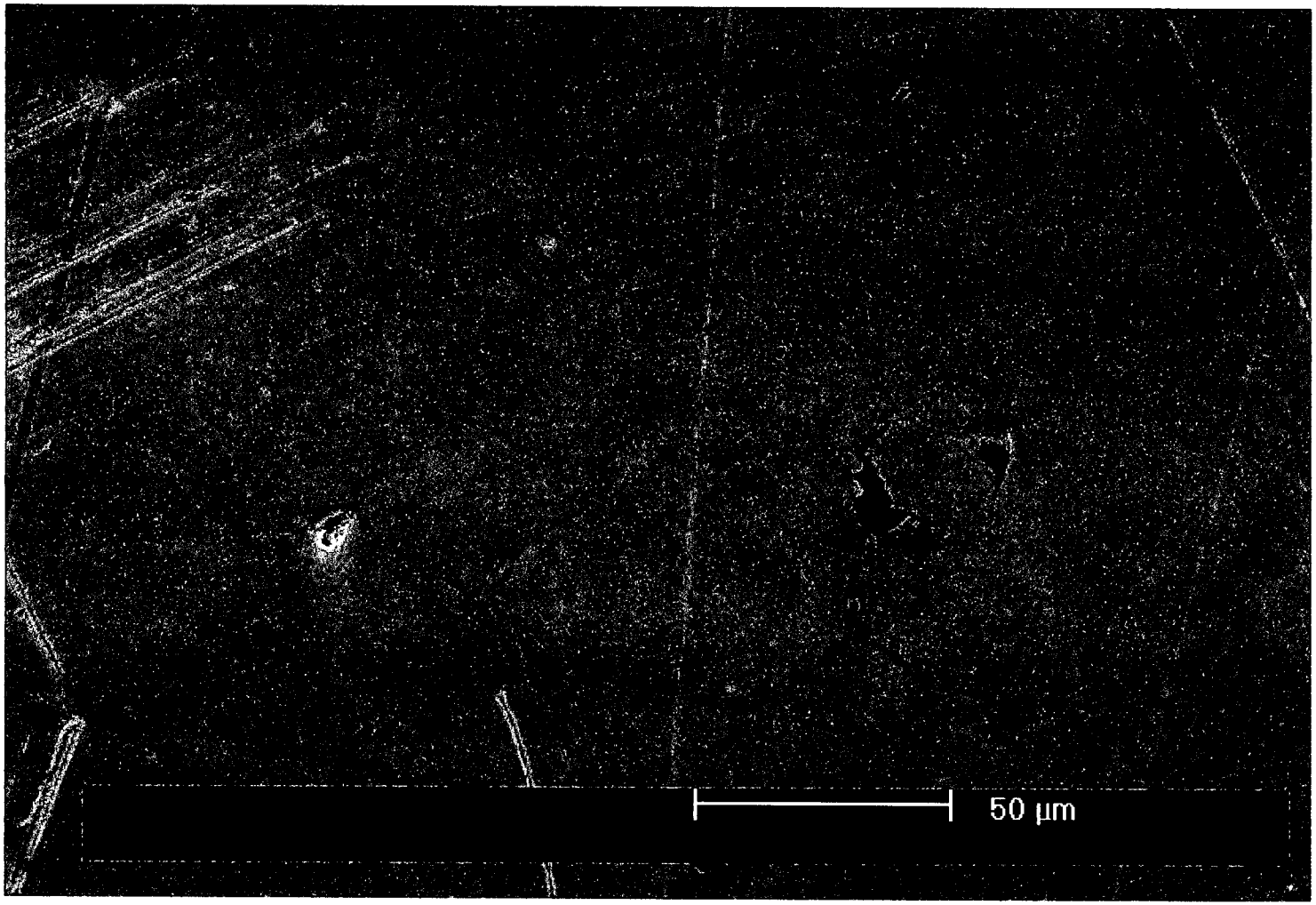
FIGS. 7 to 10 show SEM microphotographs, at different points and with different scales of enlargement, of the same sample of a Pt alloy obtained with the method according to the invention illustrated in FIG. 3.
Figure 8:
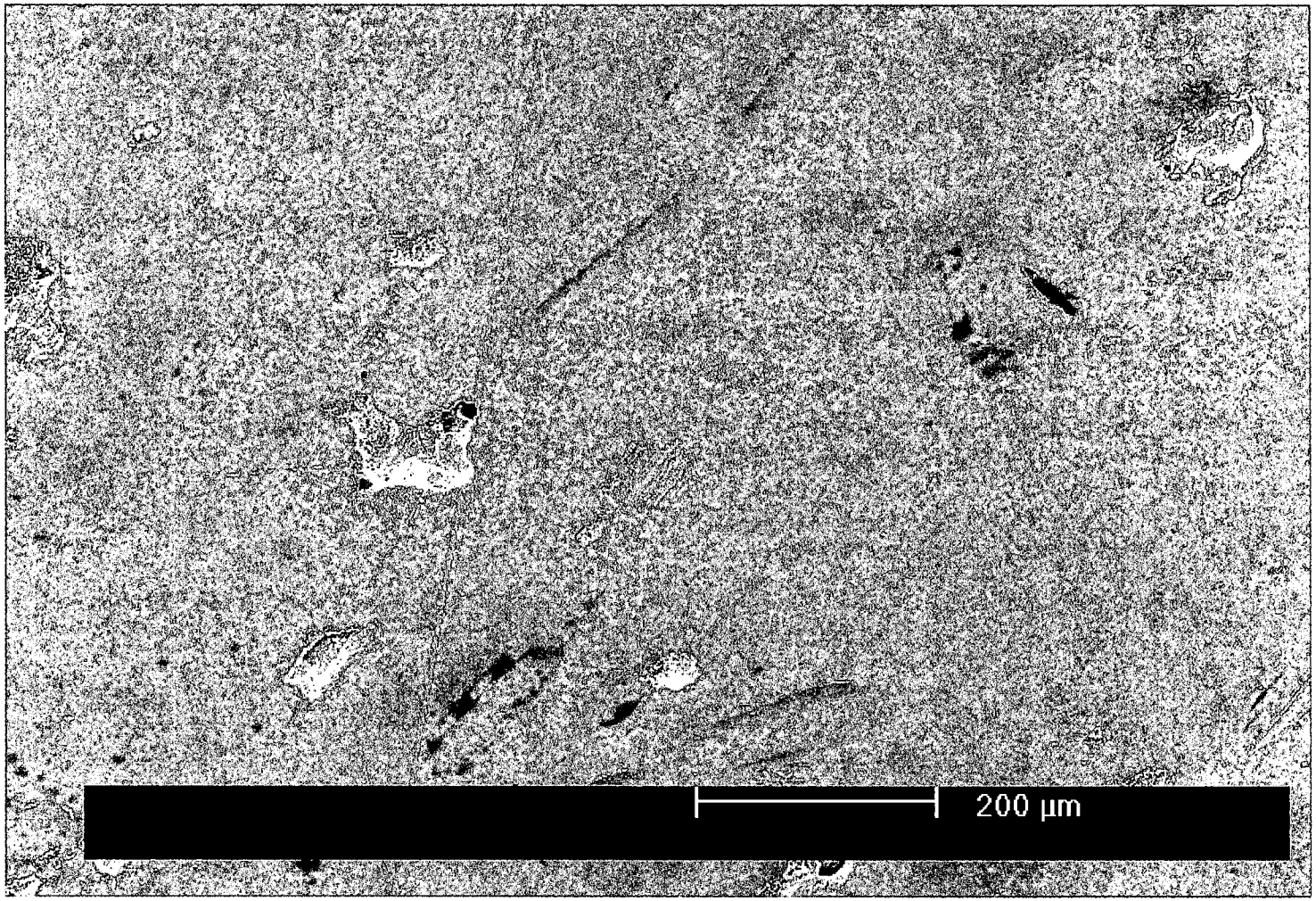
Figure 9:
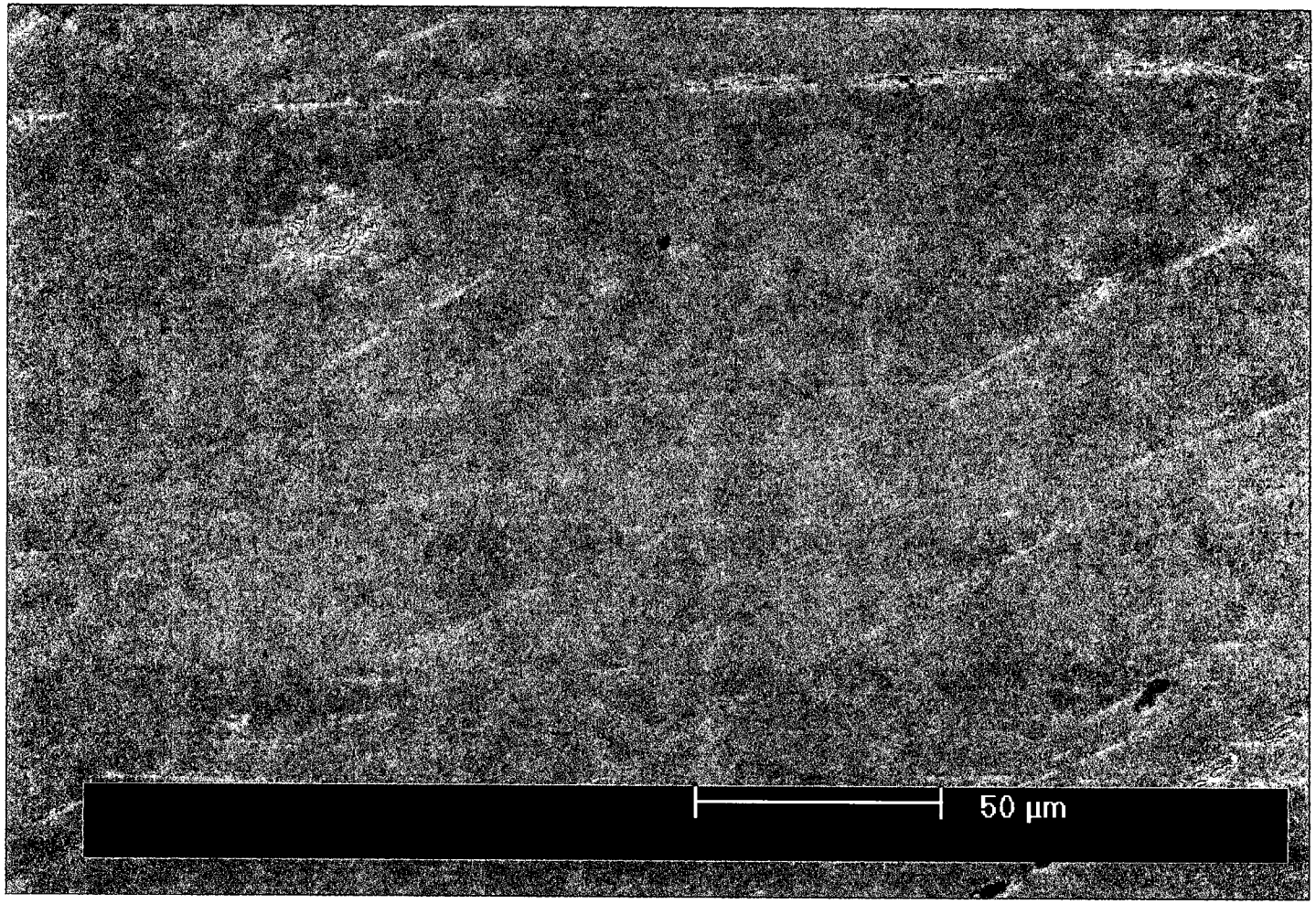
Figure 10:
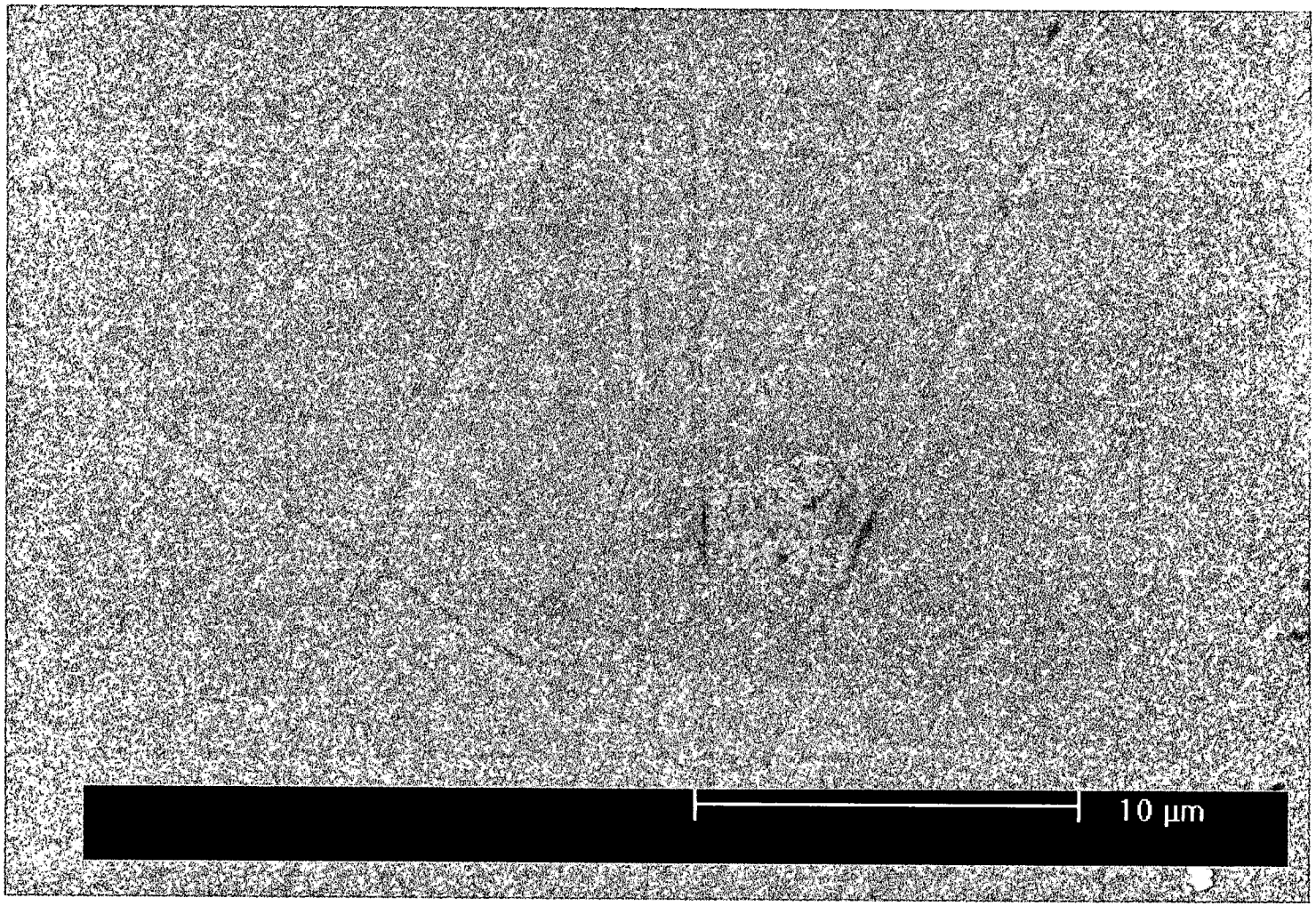

At the end of the entire process, SEM and EDAX analyses were carried out on an end product sample. From the SEM microphotographs shown in FIGS. 7 to 10, which reproduce with a varying degree of enlargement images of superficial zones of the sample, it can be noted how the granular structure of the alloy is very homogeneous with a practically uniform distribution of the platinum granules (FIG. 7 in particular). FIG. 10 is slightly marred by a conspicuous rectangular blemish, which is due to the optical focussing system of the microscope used.

The concentration values obtained by the EDAX analyses performed at various points on the sample show a deviation from the average purity index of the product which is very close to 0%. Even taking into account the error in the analysis technique used, the improvement in the homogeneity, comparing the product not subjected to heat treatment to the end product subjected to the heat treatment according to the invention, is significant.

EXAMPLE 3

Preparation of a Pt—Cu Alloy with 417/1000 Purity Index 66.72 g of platinum powder and 93.28 g of copper powder were mixed together. The mixed powder was introduced into the furnace according to Example 1, inside an alumina crucible. The powders together with the crucible had a total weight of 286.9 g.

Before the start of the process a flow of argon was circulated inside the furnace for one hour so as to eliminate the oxygen from the chamber of the furnace.

The steps of the process are illustrated in sequence in the graph according to FIG. 4. The end product with a purity index of 417/1000 consisted of a block of brilliant light grey colour. In the bottom part of the sample a crystal grain having dimensions of a few millimetres can be seen by the naked eye.

EXAMPLE 4

Preparation of a Pt—Cu Alloy with 800/1000 Purity Index 128 g of platinum powder and 32 g of copper powder were mixed together. The mixed powder was introduced into the furnace inside an alumina crucible. The total weight of the powders and the crucible was 286.9 g.

Before the start of the process, argon was circulated for one hour so as to eliminate the oxygen from the furnace chamber. The process steps are illustrated in the graph shown in FIG. 5.

The end product with a platinum content of 800/1000 consisted of a block with a brilliant light grey colour. In the bottom part of the sample a crystal grain having dimensions of a few millimetres can be seen by the naked eye.

The platinum/copper alloys obtained with the processes described in Examples 3 and 4 are distinguished by mechanical machinability properties and in particular suitability for elongation, welding and diamond-cutting, which are entirely comparable to those properties which can be found in gold alloys of the traditional type and are well-known to a person skilled in the art. These machinability properties must be considered in particular with reference to use of machinery for welding, diamond-cutting and rolling operations which are entirely conventional in the gold and silver processing sector.

The abovementioned platinum/copper alloys have also proved to be suitable for processing using alternate annealing and rolling processes so as to obtain sheets and semifinished articles which can be worked in a manner which is entirely comparable to the equivalent sheets and equivalent semifinished articles made of gold alloy.

Starting with the alloys obtained with the method according to the present invention, in particular as illustrated in the above examples, articles of jewellery which had a colour and aesthetic properties similar to those of platinum with a purity index of 950/1000 or 850/1000 were obtained. The elongation values of these alloys were between 30% and 60%. The articles were processed using standard apparatus used for the processing of gold alloys, with processing times comparable to those of the gold and silver sector and suitability for welding both with weld material and without weld material.

What is claimed is:

1. Method for producing platinum/copper alloys comprising:

a step for melting at least one predetermined quantity of platinum and at least one predetermined quantity of copper so as to obtain a fusion product with a corresponding platinum content;

a step for holding said fusion product at the melting temperature of said fusion product or at a higher temperature in order to homogenize the fusion product; said method being characterized by the fact of subjecting said fusion product to a heat treatment which consists in holding said fusion product at temperatures ranging between 900° C. and 1400° C., for a time period ranging between 2 and 20 hours, so as to obtain a platinum/copper alloy devoid of phase separation products, wherein said content by weight of platinum is between 375/1000 and 800/1000, the residual fraction by weight consisting substantially of copper, and in that said holding step is performed for a time period ranging from 1 hour to 10 hours.

2. Method for producing platinum/copper alloys comprising:

a step for melting at least one predetermined quantity of platinum and at least one predetermined quantity of copper so as to obtain a fusion product with a corresponding platinum content;

a step for holding said fusion product at the melting temperature of said fusion product or at a higher temperature in order to homogenize the fusion product; said method being characterized by the fact of subjecting said fusion product to a heat treatment which consists in holding said fusion product at temperatures ranging between 900° C. and 1400° C., for a time period ranging between 2 and 20 hours, so as to obtain a platinum/copper alloy devoid of phase separation products, wherein said content by weight of platinum is between 375/1000 and 575/1000, the residual fraction by weight consisting substantially of copper, and in that said holding step is performed for a time period ranging from 1 hour to 10 hours.

3. Method for producing platinum/copper alloys comprising:

a step for melting at least one predetermined quantity of platinum and at least one predetermined quantity of copper so as to obtain a fusion product with a corresponding platinum content;

a step for holding said fusion product at the melting temperature of said fusion product or at a higher temperature in order to homogenize the fusion product; said method being characterized by the fact of subjecting said fusion product to a heat treatment which consists in holding said fusion product at temperatures ranging between 900° C. and 1400° C., for a time period ranging between 2 and 20 hours, so as to obtain a platinum/copper alloy devoid of phase separation products, and further comprising:

a first cooling of said fusion product down to room temperature, which is carried out at the end of said holding step and is a hardening step, said heat treatment being carried out after said first cooling;

a step involving heating of said fusion product to temperatures ranging between 900° C. and 1400° C. with heating speeds ranging between 1° C./min. and 15° C./min., which is carried out at the end of said first cooling step;

a second cooling step down to room temperature, which is carried out at the end of said heat treatment and is a hardening step;

wherein said content by weight of platinum is between 375/1000 and 800/1000, the residual fraction by weight consisting substantially of copper.

4. Method according to claim 3, in which said holding step is performed for a time period ranging from 1 hour to 10 hours.

5. Method according to claim 3, in which said content by weight of platinum is between 375/1000 and 575/1000.

6. Method according to claim 3, in which said melting and holding steps are performed in a controlled atmosphere.

7. Method according to claim 6, in which said controlled atmosphere is achieved by vacuum.

8. Method according to claim 6, in which said controlled atmosphere is achieved by an inert gas.

9. Method for producing platinum/copper alloys comprising:

a step for melting at least one predetermined quantity of platinum and at least one predetermined quantity of copper so as to obtain a fusion product with a corresponding platinum content;

a step for holding said fusion product at the melting temperature of said fusion product or at a higher temperature in order to homogenize the fusion product;

said method being characterized by the fact of subjecting said fusion product to a heat treatment which consists in holding said fusion product at temperatures ranging between 900° C. and 1400° C., for a time period ranging between 2 and 20 hours, so as to obtain a platinum/copper alloy devoid of phase separation products, further comprising at the end of said holding step, a first cooling to temperatures ranging between 900° C. and 1400° C. with cooling speeds ranging between 1° C./min. and 20° C./min. and in which said heat treatment is carried out after said first cooling.

10. Method according to claim 9, in which at the end of said heat treatment a second cooling step down to room temperature with cooling speeds ranging between 1° C./min. and 20° C./min. is carried out.

11. Method according to claims 9, in which at the end of said heat treatment, a hardening step is carried out.

12. Method for producing platinum/copper alloys comprising:

a step for melting at least one predetermined quantity of platinum and at least one predetermined quantity of copper so as to obtain a fusion product with a corresponding platinum content;

a step for holding said fusion product at the melting temperature of said fusion product or at a higher temperature in order to homogenize the fusion product;

said method being characterized by the fact of subjecting said fusion product to a heat treatment which consists in holding said fusion product at temperatures ranging between 900° C. and 1400° C., for a time period ranging between 2 and 20 hours, so as to obtain a platinum/copper alloy devoid of phase separation products comprising at the end of said holding step, a first cooling of said fusion product down to room temperature, and in which said heat treatment is carried out after first cooling, and in which at the end of said heat treatment a second cooling step down to room temperature with cooling speeds ranging between 1° C./min. and 20° C./min. is carried out.

* * * * *